US007959496B2

(12) United States Patent
Spiegel

(10) Patent No.: US 7,959,496 B2
(45) Date of Patent: Jun. 14, 2011

(54) FLEXIBLE MEMBRANE ASSEMBLY FOR A CMP SYSTEM AND METHOD OF USING

(75) Inventor: Larry A. Spiegel, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 498 days.

(21) Appl. No.: 11/969,175

(22) Filed: Jan. 3, 2008

(65) Prior Publication Data

US 2009/0176445 A1 Jul. 9, 2009

(51) Int. Cl.

| | |
|---|---|
| ***B24B 1/00*** | (2006.01) |
| ***B24B 5/02*** | (2006.01) |
| ***B24B 5/35*** | (2006.01) |

(52) U.S. Cl. ..... 451/59; 451/41; 451/288; 451/290; 451/398; 451/442

(58) Field of Classification Search ..... 451/36, 451/41, 59, 63, 285, 286, 287, 288, 289, 451/290, 397, 398, 442

See application file for complete search history.

(56) References Cited

U.S. PATENT DOCUMENTS

| | | | | |
|---|---|---|---|---|
| 6,012,964 | A | 1/2000 | Arai et al. | |
| 6,210,255 | B1 | 4/2001 | Zuniga et al. | |
| 6,872,130 | B1 * | 3/2005 | Zuniga | 451/287 |
| 6,966,822 | B2 | 11/2005 | Kajiwara et al. | |
| 7,033,252 | B2 * | 4/2006 | Fuhriman et al. | 451/41 |

* cited by examiner

*Primary Examiner* — Timothy V Eley

(74) *Attorney, Agent, or Firm* — K. David Crockett, Esq.; Crockett & Crockett, PC

(57) ABSTRACT

A flexible membrane assembly for a wafer carrier in a CMP system. The flexible membrane assemble has a flat, flexible membrane joined to a rigid cylindrical sidewall.

17 Claims, 4 Drawing Sheets

21
10
1
20
5
5
4
2
22
3
3
2
8
8
9
9
7
6

FLEXIBLE MEMBRANE ASSEMBLY FOR A CMP SYSTEM AND METHOD OF USING

FIELD OF THE INVENTIONS

The inventions described below relate the field of wafer carriers and particularly to wafer carriers used during chemical mechanical planarization of silicon wafers.

BACKGROUND OF THE INVENTIONS

Integrated circuits, including computer chips, are manufactured by building up layers of circuits on the front side of silicon wafers. An extremely high degree of wafer flatness and layer flatness is required during the manufacturing process. Chemical-mechanical planarization (CMP) is a process used during device manufacturing to flatten wafers and the layers built-up on wafers to the necessary degree of flatness.

Chemical-mechanical planarization is a process involving polishing of a wafer with a polishing pad combined with the chemical and physical action of a slurry pumped onto the pad. The wafer is held by a wafer carrier, with the backside of the wafer facing the wafer carrier and the front side of the wafer facing a polishing pad. The polishing pad is held on a platen, which is usually disposed beneath the wafer carrier. Both the wafer carrier and the platen are rotated so that the polishing pad polishes the front side of the wafer. A slurry of selected chemicals and abrasives is pumped onto the pad to affect the desired type and amount of polishing. (CMP is therefore achieved by a combination of chemical softener and physical downward force that removes material from the wafer or wafer layer.)

Using the CMP process, a thin layer of material is removed from the front side of the wafer or wafer layer. The layer may be a layer of oxide grown or deposited on the wafer or a layer of metal deposited on the wafer. The removal of the thin layer of material is accomplished so as to reduce surface variations on the wafer. Thus, the wafer and layers built-up on the wafer are very flat and/or uniform after the process is complete. Typically, more layers are added and the chemical mechanical planarization process repeated to build complete integrated circuit chips on the wafer surface.

A variety of wafer carrier configurations are used during CMP. One such wafer carrier configuration is the hard backed configuration. The hard backed configuration utilizes a rigid surface such as a piston or backing plate against the backside of the silicon wafer during CMP forcing the front surface of the silicon wafer to the surface of the polishing pad. Using this type of carrier may not conform the front wafer surface of the wafer to the surface of the polishing pad resulting in planarization non-uniformities. Such hard backed wafer carrier designs generally utilize a relatively high polishing pressure. These relatively high pressures effectively deform the wafer to match the surface conformation of the polishing pad. When wafer surface distortion occurs, the high spots are polished at the same time as the low spots giving some degree of uniformity but also resulting in poor planarization. Too much material from some areas of the wafer will be removed and too little material from other areas will also be removed. In addition to wafer distortion, the relatively high pressure also results in excessive material removal along the edges of the silicon wafer. When the amount of material removed is excessive, the entire wafer or portions of the wafer become unusable.

In other wafer carrier configurations, the wafer is pressed against the polishing pad using a membrane or other soft material. Use of a membrane carrier tends to avoid or limit distortion of the wafer. Lower polishing pressures may be employed, and conformity of the wafer front surface is achieved without distortion so that both some measure of global polishing uniformity and good planarization may be achieved. Better planarization uniformity is achieved at least in part because the polishing rate on similar features from die to die on the wafer is the same.

In our prior patents, Fuhriman, et al., Wafer Carrier with Pressurized Membrane and Retaining Ring Actuator, U.S. Pat. No. 7,238,083 (Apr. 25, 2006) and Spiegel, Independent Edge Control for CMP Carriers, U.S. Pat. No. 7,033,252 (Jun. 20, 2006) we disclose CMP systems which employ flexible membrane assemblies, and disclose inventive features which provide for enhanced control of the CMP process to limit the edge effect. The flexible membrane assemblies comprise a round pan-like assembly, constructed of a single piece of synthetic rubber or other pliable material. The membrane portion of the pan (the bottom) is held in place within the wafer carrier by its cylindrical side-wall and its flange which are trapped within other components of the wafer carrier. Along with the advances shown in our prior patents, this construction aids in the reduction of the edge effect which limits yield in CMP processes.

SUMMARY

The methods and devices described below provide for a wafer carrier adapted to further reduce the edge effect and allow a wafer to be uniformly polished across its entire surface. A flexible membrane assembly is provided for use in the wafer carrier, upon which pressurized air and/or pressurized bladder act to control wafer backpressure during polishing. The flexible membrane assembly comprises a flat flexible membrane, a relatively rigid cylindrical side-wall, and a flexible flange for interconnection with the wafer carrier components. This construction of the membrane assembly helps reduce the edge-effect in the CMP process and may also reduce vibration in the CMP process. The construction is also easier to make because it is easier to control the dimensions of the rigid cylindrical side-wall than it is to control the dimensions of a molded single piece membrane assembly. The construction also makes it practical to use fluorelastomers, which are very difficult to mold to the close tolerances required in CMP wafer carrier components, as the membrane material, and the membranes can be cut from sheets of known thickness.

DETAILED DESCRIPTION OF THE INVENTIONS

Figure 1:
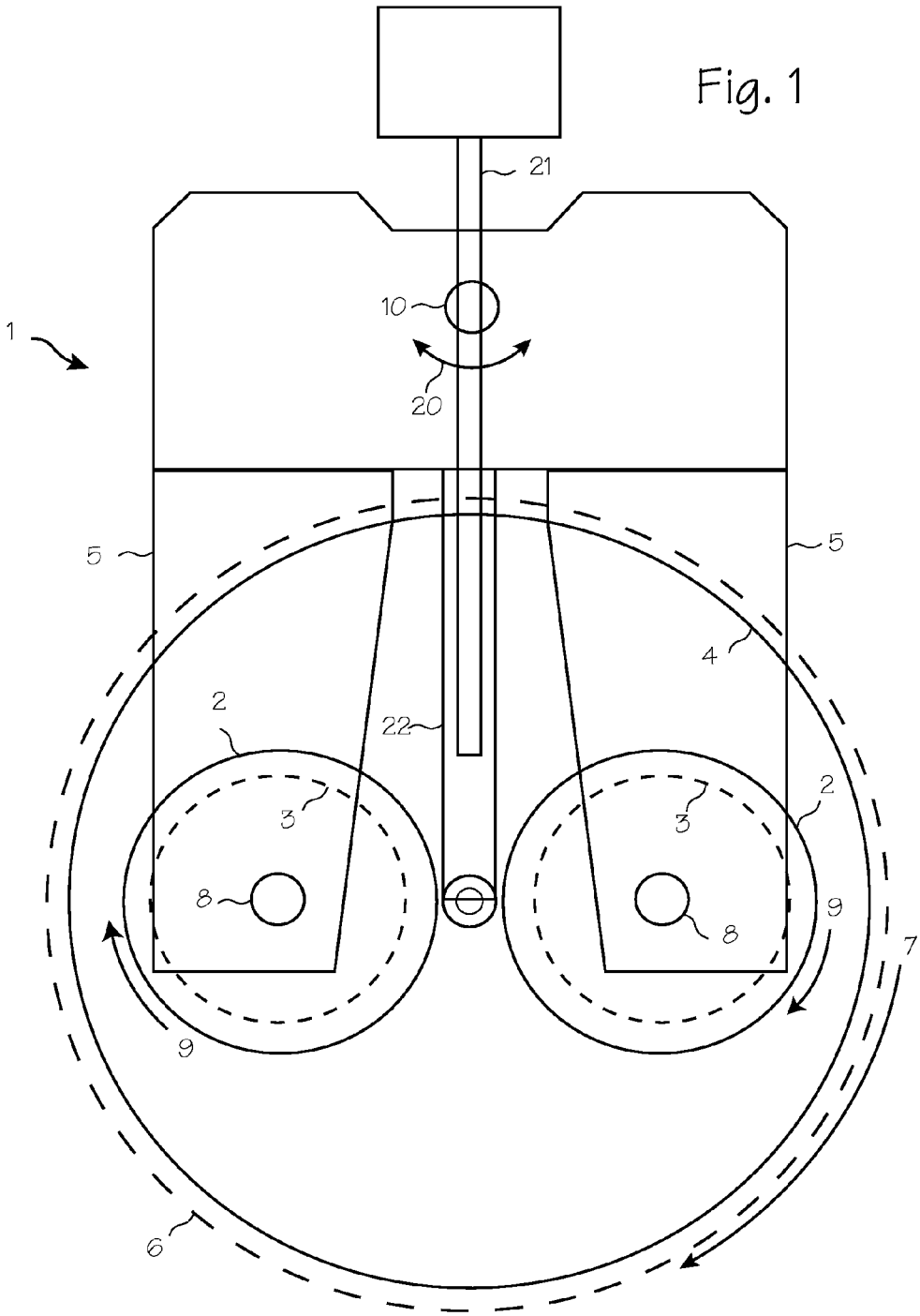
FIG. 1 shows a system for performing chemical mechanical planarization.

FIG. 1 shows a system 1 for performing chemical mechanical planarization (CMP). One or more polishing heads or wafer carriers 2 hold wafers 3 (shown in phantom to indicate their position underneath the wafer carrier) suspended over a polishing pad 4. A wafer carrier 2 thus has a means for securing and holding a wafer 3. The wafer carriers 2 are suspended from translation arms 5. The polishing pad is disposed on a platen 6, which spins in the direction of arrows 7. The wafer carriers 2 rotate about their respective spindles 8 in the direction of arrows 9. The wafer carriers 2 are also translated back and forth over the surface of the polishing pad by the translating spindle 10, which moves as indicated by arrows 20. The slurry used in the polishing process is injected onto the surface of the polishing pad through slurry injection tube 21, which is disposed on or through a suspension arm 22. (Other chemical mechanical planarization systems may use only one wafer carrier 2 that holds one wafer 3, or may use several wafer carriers 2 that hold several wafers 3. Other systems may also use separate translation arms to hold each carrier.)

Figure 2:
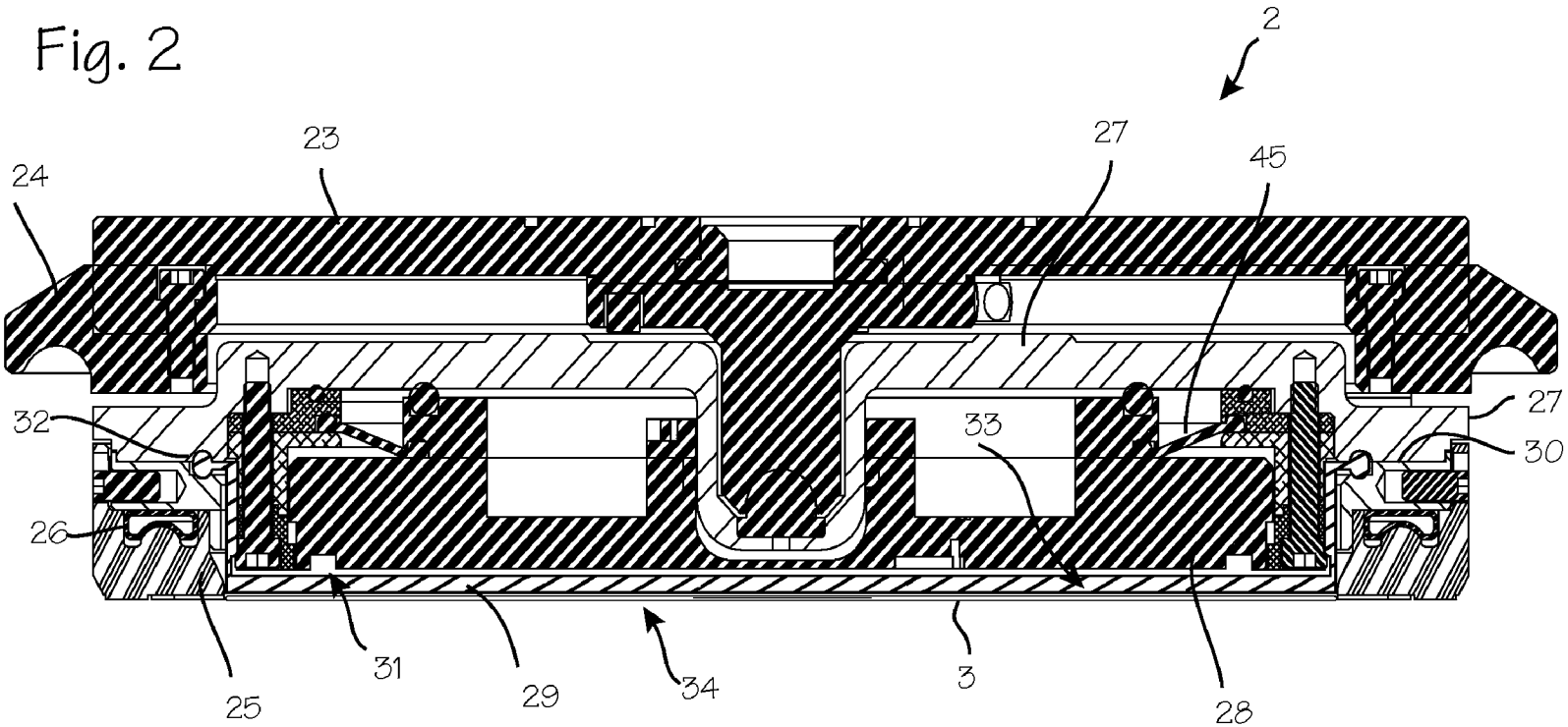
FIG. 2 shows a cross-sectional view of a wafer carrier having a pressure-regulated flexible membrane and retaining ring actuator.

FIG. 2 shows a cross section of a wafer carrier. The wafer carrier 2 includes a top plate 23 couplable to the spindle 8, a housing 24 coupled to the top plate 23, a gimbal plate 28 coupled to the housing, a retaining ring 25 coupled to the gimbal plate 28, a retaining ring actuator 26 disposed in the retaining ring 25, a piston plate 27 coupled to the manifold plate 28 via the rubber spring element 28 and a pressure regulated flexible membrane 29, secured to the manifold plate by membrane clamp ring 30. The membrane is shown, isolated from the other components of the wafer carrier, in FIG. 3. The membrane may be made of a synthetic rubber or other pliable material. The piston plate 27 is disposed within the inner diameters of the housing 24 and retaining ring 25. When a pressurized fluid is applied, the pressurized fluid flows through the passage to the recessed regions in the lower face 31 of the piston plate 27. The fluid may be liquid or gaseous. The pressurized fluid urges the flexible membrane 29 downwardly away from the lower face 31 of the piston plate 27.

The flexible membrane 29 extends horizontally over a peripheral portion of the backside of the wafer 3 and extends vertically between the side of the piston plate 27 and the retaining ring 25 and gimbal plate 28. An extension of the membrane 29 projects into an annular space 32 provided in the gimbal plate 28. Thus, the pressure-regulated flexible membrane 29 moves with the wafer and the piston plate but, during polishing, moves independently of the movement of the gimbal plate 28 and the retaining ring 25. Pressure in the flexible membrane is adjusted by a control computer to apply downward force to the backside 33 of the wafer and to ensure that the rate at which material is removed from the front side 34 of the wafer is uniform across the entire front side of the wafer.

The retaining ring actuator in the wafer carrier 2 is independently controlled and affects the amount of force being applied behind the retaining ring 25. A retaining ring actuator 26 is provided within the retaining ring 25. When the actuator is pressurized, it extends against the retaining ring and increases the amount of force being applied to the polishing pad by the retaining ring relative to the rest of the wafer carrier 2. The retaining ring 25 is attached to the gimbal plate 28 in such a manner that allows the pressure inside the retaining ring actuator 26 to be increased or decreased. Change of pressure within the retaining ring actuator will influence the amount of force acting on the polishing pad by the retaining ring. Using a control computer, pressure in the retaining ring actuator 26 is regulated independent of the pressure in the inflatable membrane 29. Pressure inside the retaining ring actuator 26 is used to force the retaining ring 25 downwardly as material is removed from the bottom surface of the retaining ring 25.

Figure 3:
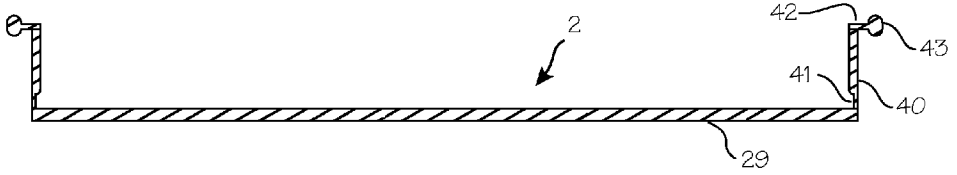
FIG. 3 is a cross section of the flexible membrane assembly.
Figure 4:
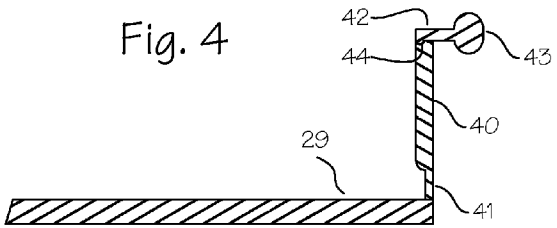
FIG. 4 is a cross-section the flexible membrane, illustrating the construction of the membrane assembly, in which a flat sheet of membrane material is joined to the cylindrical wall.

FIGS. 3 and 4 are cross-sections the flexible membrane assembly, illustrating the construction of the membrane assembly, in which a flat sheet of membrane material is joined to the cylindrical wall. In this embodiment, the membrane assembly comprises the membrane 29, a cylindrical sidewall 40 with an undercut forming the thin walled lower section 41 near the join of the membrane, a flange 42 extending outwardly from the cylindrical sidewall, and a bead 43 on the flange. The flange includes a downwardly extending bead 44 which fits into a corresponding annular groove on the upper surface of the cylindrical wall. Together with the manifold plate and rubber spring element (items 28 and 45 in FIG. 2), the membrane assembly forms a fluid-tight space which may be pressurized by the control system, acting in conjunction with the pressure source, to control the backpressure on the wafer during the CMP process.

The dimensions of the membrane assembly and its components can varied to fit various wafer carriers. For use in Strasbaugh™ 200 mm wafer carriers, the sidewall has an overall diameter of 200 mm (7.86"), a wall height of 1.73 cm (0.682") and a wall thickness of 2 mm (0.080"). The bead and flange are sized and dimensioned, as shown in FIG. 2, to fit within the annular space 32 of the assembled wafer carrier.

The sidewall is made of a rigid or inelastic material, such as ABS plastic, polyethylene terephthalate (PET), polyurethane, polyvinyl chloride, polymethyl methacrylate (Lucite®, Plexiglas®), polycarbonate (Lexan®), and may be furthered stiffened with the addition of carbon fibers or metal layers. The membrane is made of a flexible, elastic material such as rubber, synthetic rubber (neoprene, for example), silicone rubber, nitrile, fluorelastomers (Viton®), urethane and polyurethane foams (Poron®), hydrated acrylonitrile butadiene rubber (HNBR), vinyl, TPE (thermoplastic elastomer). The cylindrical sidewall is most conveniently made by cutting pre-formed cylinders of plastic. The membrane assembly is constructed by cutting the circular membrane from a flat sheet of material, and gluing or melting the flat sheet to the bottom edge of the cylindrical sidewall. The membrane may be cut to size either before or after it is secured to the cylinder. The membrane may be pre-tensioned (stretched) prior to securing it to the cylindrical sidewall, if necessary to prevent droop of the membrane during use which might interfere with wafer loading and sensing. The flange and bead are preferably made of a flexible, elastic material such as synthetic rubber, silicone rubber, nitrile, Viton, Poron, HNBR, Vinyl, TPE (thermoplastic elastomer), formed by injection molding or any other suitable manner, and may also be joined to the cylindrical wall by gluing or melting the two together. The flange and bead components may be varied, for example by providing the flange as an inwardly extending flange, or providing additional structures, to provide mounting or retaining structures suitable for a variety of different wafer carrier constructions (see FIGS. 8 and 9.) The flange may also be formed integrally with the cylinder, and comprise the same material, in wafer carrier arrangements in which the flange need not be flexible.

Figure 5:
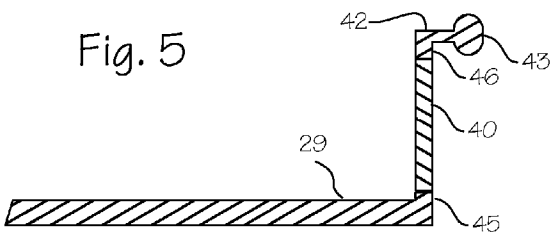
FIG. 5 is a cross-section the flexible membrane, illustrating the construction of the membrane assembly, in which the membrane with a short rim is glued to the cylindrical wall.

FIG. 5 is a cross-section the flexible membrane, illustrating the construction of the membrane assembly in which a membrane with a short rim is glued to the cylindrical sidewall. In this embodiment, the membrane 29 is manufactured with a short upwardly extending rim 46. The upper surface of the rim wall is flat, and is butt-joined to the flat lower surface of the cylindrical sidewall. The beaded flange 42 is also formed with a short downwardly extending rim 47, which is butt-joined to the flat upper surface of the cylindrical sidewall.

Figure 6:
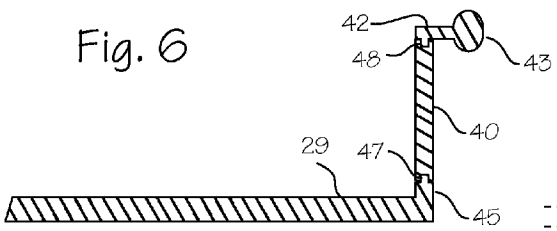
FIG. 6 is a cross-section the flexible membrane, illustrating the construction of the membrane assembly, in which the membrane is over-molded with the cylindrical wall.

FIG. 6 is a cross-section the flexible membrane, illustrating the construction of the membrane assembly, in which the membrane and flange are over-molded onto the cylindrical wall. The cylindrical sidewall 40 is formed with an annular groove in the upper edge and the lower edge of the wall. The membrane is provided with a short upwardly extending rim 46, with a small annular ridge 48 which fits into the annular groove in the lower edge of the cylindrical wall. The flange is provided with a downwardly extending annular ridge 49 which fits in to a corresponding annular groove on the upper edge of the cylindrical wall. This construction can be made by overmolding or co-molding the membrane and flange with the cylindrical wall, or by gluing or melting the membrane and flange onto the cylindrical wall.

Figure 7:
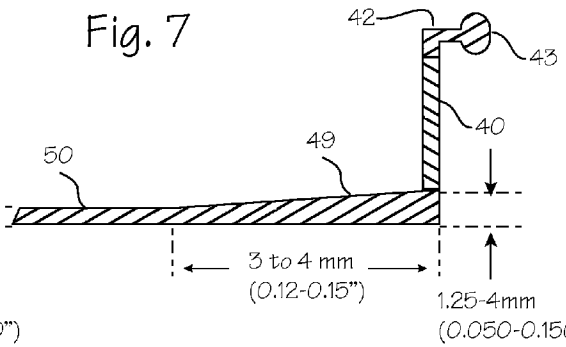
FIG. 7 is a cross-section the flexible membrane, illustrating the construction of the membrane assembly with a membrane which has a thick peripheral region joined to the cylindrical wall.

FIG. 7 is a cross-section the flexible membrane, illustrating the construction of the membrane assembly with a membrane which has a thick peripheral region joined to the cylindrical wall. The sidewall and flange may be constructed as described above in relation to FIGS. 4, 5 and 6. The peripheral region 50 of the membrane is thicker than the center region 51 of the membrane. As illustrated in FIG. 7, the peripheral band of the membrane (a band of about 3 to 4 mm) tapers inwardly from a thickness of 1.25-4 mm (0.050-0.150")) at the edge of the membrane to a thickness of about 0.75 mm to 2.5 mm (0.030-0.010") at the inner edge of the peripheral zone.

Figure 8:
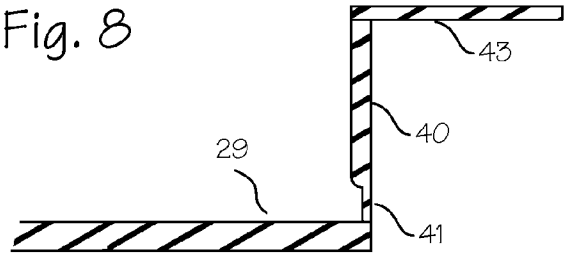
FIGS. 8 and 9 illustrate an embodiment of the flexible membrane assembly in which both the membrane and the flange are cut from flat sheets of rubber.
Figure 9:
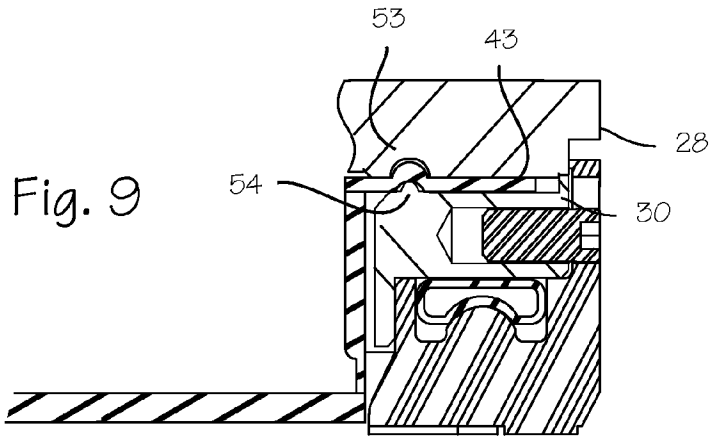

FIGS. 8 and 9 illustrate an embodiment of the flexible membrane assembly in which both the membrane and the flange are cut from flat sheets of rubber. The cylindrical sidewall 40 and flexible membrane 29 are constructed as described above. The flange 52 is a flat ring joined to the top of the cylindrical wall. This flange is formed by cutting a flat ring from a flat sheet of flexible material, and is glued, melted or otherwise secured to the cylindrical sidewall. As shown in FIG. 9, when assembled with the wafer carrier, the flat flange 52 is trapped between the manifold plate 28 and the membrane clamp ring 30. Compression of the flange between the manifold plate and membrane clamp ring provides and adequate seal for the pressurized space. An annular groove 53 on the lower surface of the manifold plate and a corresponding annular ridge 54 on the membrane clamp ring serve to lock the flange in place and secure the seal. Various other arrangements can be made secure the membrane assembly in place. For example, a bead or flange of may be provided on the outer wall of the cylindrical sidewall 40, accommodated by a corresponding groove around the inner circumference of the membrane clamp ring 46, so that the flange 42 may be cut from a flat sheet, and need not be injection molded. In wafer carrier embodiments where the flange 42 is not necessary to seal the membrane space, the flange may be dispensed with altogether if a bead on the outer wall of the cylinder in cooperative engagement with groove on the inner surface of the retaining ring or other ring structure is sufficient to seal the space.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A method of polishing a wafer comprising the steps of:

providing a wafer carrier comprising a piston plate;

providing a flexible membrane assembly comprising a rigid cylinder and a flexible membrane spanning the cylinder to form a pan-like structure;

disposing the flexible membrane assembly about the piston plate;

translating the wafer carrier relative to a polishing pad while the wafer is held between the flexible membrane and the polishing pad;

wherein the cylinder comprises a material selected from the group of ABS plastic, polyethylene terephthalate, polyurethane, polyvinyl chloride, polymethyl methacrylate, polycarbonate; and wherein the membrane comprises a material selected from the group of rubber, synthetic rubber, silicone rubber, nitrile, fluorelastomers, urethane and polyurethane foams, hydrated acrylonitrile butadiene rubber, Vinyl, and thermoplastic elastomer.

2. The method of claim 1 further comprising the steps of:

forming the flexible membrane assembly by forming the membrane from a flat sheet of the flexible material, and securing the membrane to the rigid cylinder.

3. The method of claim 1 further comprising the steps of:

tensioning the flexible membrane prior to securing the membrane to the rigid cylinder.

4. A wafer carrier for use in a system for polishing wafers comprising:

a housing;

a piston plate within the housing;

a retaining ring characterized by an inner diameter, said retaining ring coupled to the housing, said retaining ring sized and dimensioned to receive the wafer;

a flexible membrane assembly comprising a flexible membrane, a rigid cylindrical sidewall, said flexible membrane being secured to the bottom of the sidewall, and a flange extending from the top of the sidewall, said flexible membrane assembly disposed within the retaining ring;

wherein the flexible membrane further comprises an upwardly extending annular ridge, and the rigid sidewall further comprises an annular groove disposed on the lower edge of the wall, with the annular ridge disposed within the annular groove to secure the flexible membrane to the rigid sidewall.

5. The wafer carrier of claim 4, wherein the flexible membrane assembly is further characterized by a peripheral region which is substantially thicker than the center region of flexible membrane.

6. The wafer carrier of claim 4, wherein the flexible membrane assembly further comprises a flexible flange extending from the rigid cylindrical sidewall, and the wafer carrier further comprises a membrane clamp operable to secure the membrane to the carrier.

7. The wafer carrier of claim 6, wherein the flexible membrane assembly further comprises a bead or ridge disposed on the flexible membrane assembly for mounting the flexible membrane assembly within the carrier.

8. The wafer carrier of claim 4, wherein the flexible membrane is pre-tensioned prior to being secured to the sidewall.

9. The wafer carrier of claim 4, wherein the rigid sidewall has a region of reduced thickness proximate the bottom of the rigid sidewall.

10. A wafer carrier for use in a system for polishing wafers comprising:

a housing;

a piston plate within the housing;

a retaining ring characterized by an inner diameter, said retaining ring coupled to the housing, said retaining ring sized and dimensioned to receive the wafer;

a flexible membrane assembly comprising a flexible membrane, a rigid cylindrical sidewall, said flexible membrane being secured to the bottom of the sidewall, and a flange extending from the top of the sidewall, said flexible membrane assembly disposed within the retaining ring;

wherein the flexible membrane assembly is further characterized by a peripheral region which is substantially thicker than the center region of flexible membrane;

wherein the flexible membrane peripheral region has a thickness of about 1.25 to 4 mm (0.050 to 0.150 inches) and the center region of flexible membrane has a thickness of about .75 to 2.5 mm (0.030 to 0.10 inches), and said peripheral region comprises a band of about 3 to 4 mm (0.12 to 0.15 inches) on the periphery of the membrane.

11. A wafer carrier for use in a system for polishing wafers comprising:

a housing;

a piston plate within the housing;

a retaining ring characterized by an inner diameter, said retaining ring coupled to the housing, said retaining ring sized and dimensioned to receive the wafer;

a flexible membrane assembly comprising a flexible membrane, a rigid cylindrical sidewall, said flexible membrane being secured to the bottom of the sidewall, and a flange extending from the top of the sidewall, said flexible membrane assembly disposed within the retaining ring;

wherein the rigid cylindrical sidewall comprises a rigid material selected from the group of ABS plastic, polyethylene terephthalate, polyurethane, polyvinyl chloride, polymethyl methacrylate, polycarbonate; and the flexible membrane comprises a flexible material selected from the group of rubber, synthetic rubber, silicone rubber, nitrile, fluorelastomers, urethane and polyurethane foams, hydrated acrylonitrile butadiene rubber, Vinyl, and thermoplastic elastomer.

12. A flexible membrane assembly for use in a wafer carrier of a system for polishing wafers, said flexible membrane assembly comprising:

a rigid cylinder;

a flexible membrane spanning the bottom of the cylinder;

wherein the cylinder comprises a rigid material selected from the group of ABS plastic, polyethylene terephthalate, polyurethane, polyvinyl chloride, polymethyl methacrylate, polycarbonate; and the membrane comprises a flexible material selected from the group of rubber, synthetic rubber, silicone rubber, nitrile, fluorelastomers, urethane and polyurethane foams, hydrated acrylonitrile butadiene rubber, Vinyl, and thermoplastic elastomer.

13. The flexible membrane assembly of claim 12 further comprising:

a flexible flange extending outwardly from the top of the rigid cylinder.

14. The flexible membrane assembly of claim 12, wherein the flexible membrane is pre-tensioned prior to being secured to the sidewall.

15. A method of making a flexible membrane assembly for use in a wafer carrier to perform CMP processes on a wafer, said method comprising the steps of:

providing a cylinder comprising a rigid material;

providing a membrane comprising a flexible material, said membrane formed by cutting a circular piece from a flat sheet of the flexible material;

securing the membrane to the cylinder to form a pan-like assembly.

16. The method of claim 15 further comprising the steps of:

tensioning the flexible material prior to securing the membrane to the cylinder.

17. The method of claim 15 further comprising the steps of:

selecting the material of the cylinder from the group of ABS plastic, polyethylene terephthalate, polyurethane, polyvinyl chloride, polymethyl methacrylate, and polycarbonate; and selecting the material of the membrane from the group of rubber, synthetic rubber, silicone rubber, nitrile, fluorelastomers, urethane and polyurethane foams, hydrated acrylonitrile butadiene rubber, Vinyl, and thermoplastic elastomer.

* * * * *